United States Patent [19]

Gilbert et al.

[11] 4,143,264

[45] Mar. 6, 1979

[54] HIGHWAY LINE DETECTOR

[76] Inventors: William J. Gilbert, 912 Chatterson Rd., Huntsville, Ala. 35802; Ronald W. Klassen, 2502 Pentelope Rd., Huntsville, Ala. 35803

[21] Appl. No.: 843,973

[22] Filed: Oct. 20, 1977

[51] Int. Cl.[2] ..... H01J 39/12

[52] U.S. Cl. ..... 250/210; 250/202; 250/214 B

[58] Field of Search ..... 340/31 R, 32, 34, 22, 340/39 R, 52 R, 573, 190, 201 P, 38 P, 38 R; 250/214 B, 214 R, 214 RC, 202, 209, 210; 180/98, 10 SE

[56] References Cited

U.S. PATENT DOCUMENTS

| | | | |
|---|---|---|---|
| 3,719,149 | 3/1973 | Masin | 250/210 |
| 3,811,046 | 5/1974 | Levick | 250/214 B |
| 4,003,445 | 1/1977 | De Bruine | 180/98 |

*Primary Examiner*—David C. Nelms
*Attorney, Agent, or Firm*—C. A. Phillips

[57] ABSTRACT

A highway line detection system for an automobile which provides an output signal when a traffic line on a pavement under an automobile is about to be crossed. It includes a photoelectric sensor connected to an electrical bridge circuit, and the bridge circuit includes an impedance element which is varied in impedance responsive to the integrated output of the bridge circuit, and thereby the bridge circuit is maintained in balance for ambient light conditions. Further, the threshold of detection of the system, at which point an alarm is sounded, is varied as a function of the ambient light state, whereby the sensitivity of the system is increased for low light conditions and decreased for high light conditions to compensate for an opposite characteristic of the photosensor.

9 Claims, 3 Drawing Figures

HIGHWAY LINE DETECTOR

BACKGROUND OF THE INVENTION

1. Field of the Invention

This invention relates to systems for enabling a driver of a motor vehicle to be alerted to the crossing or close proximity of a traffic line marking traffic lanes of a highway.

2. General Description of the Prior Art

Many accidents result from motor vehicles straying from one lane of traffic to another. Such events occur for a variety of reasons—simple inadvertance, the driver going to sleep or being intoxicated, and from poor visibility resulting from fog or rain. Thus it would be desirable for motor vehicles, trucks, buses, and passenger cars to be equipped with means for alerting a driver to such an occurrence to enable the driver to take timely corrective action. To this end, it has been previously proposed that photoelectric means be employed to sense when a vehicle closely approaches a traffic line on a pavement of a highway, traffic lines being generally of lighter color than the pavement. Unfortunately, however, the requirements for a practical and workable system employing such means are not readily apparent, and it does not appear that they have been met by previously proposed systems known to the applicants. For example, there is the problem of adequately distinguishing between ambient light and a change in light due to the detection of a line. A previously proposed system provides for the use of two photosensors connected in an electrical bridge circuit, whereby with equal illumination to both of the sensors, the bridge would be balanced. The photosensors are mounted on the vehicle so that one of them responds to light from the pavement under the center of the vehicle and the other to light near the side of the vehicle, and thus the latter would provide an increased output when that side of the vehicle approached a highway line, while the other one would not, causing an unbalance in the bridge and a signal to be provided to the driver of the vehicle. One difficulty with this system is that it requires that the pavement be artificially illuminated (at significant cost in energy) even in the daytime to maintain a sufficiently constant ambient light state for proper operation of the system. To accomplish this feat is indeed questionable because the intensity of natural sunlight is much greater than that of artificial light, and for one to achieve a perfect balance between the two sources is highly doubted. A second problem with this type of system is that in order to sense traffic lines on both sides of a vehicle, such as proposed by the present invention, it appears that separate illuminating sources would be required, and there would be created problems of still increased energy cost and of balance between light supplied by one and the other, or else two separate systems would be required.

Still another difficulty with the previously proposed system is that it fails to take into account the difference in sensitivity of existing photodetectors at different levels of ambient light, which are bound to occur even where supplemental light is employed, making it difficult or next to impossible to determine a fixed signal threshold, at which point a signal should trigger an alarm.

A further difficulty with the previously proposed system is that it provides for a signal output only during the period that an increased light (from a detected stripe) is sensed, and this may be for only milliseconds, a period which is too short for assurance that the signal will be observed by the driver.

A still further difficulty is that it appears that the previously proposed system would suffer from both temperature and general electrical instability.

SUMMARY OF THE INVENTION

In accordance with the invention, a photoelectrical sensor would be positioned on at least one side of a motor vehicle and oriented and baffled to observe reflected light from a roadway. The photoelectric sensor or sensors (typically there would be one on each side of the vehicle) would be connected in an electrical bridge circuit wherein there is also included an impedance element which is controlled by an integrated output of the bridge circuit to thereby maintain a balance of the bridge for ambient light conditions. Further, the threshold of response of the system is varied as a function of current through the photosensors, providing a lower threshold for low ambient light-low current conditions where the sensitivity of the photosensors is typically lowest, and providing a higher threshold at higher ambient light-high current conditions where the photosensors are at their greatest sensitivity.

It is the object of this invention to solve the foregoing and other problems and to provide a truly reliable and effective highway line detection system.

DETAILED DESCRIPTION OF THE DRAWINGS

Figures 1, 3:
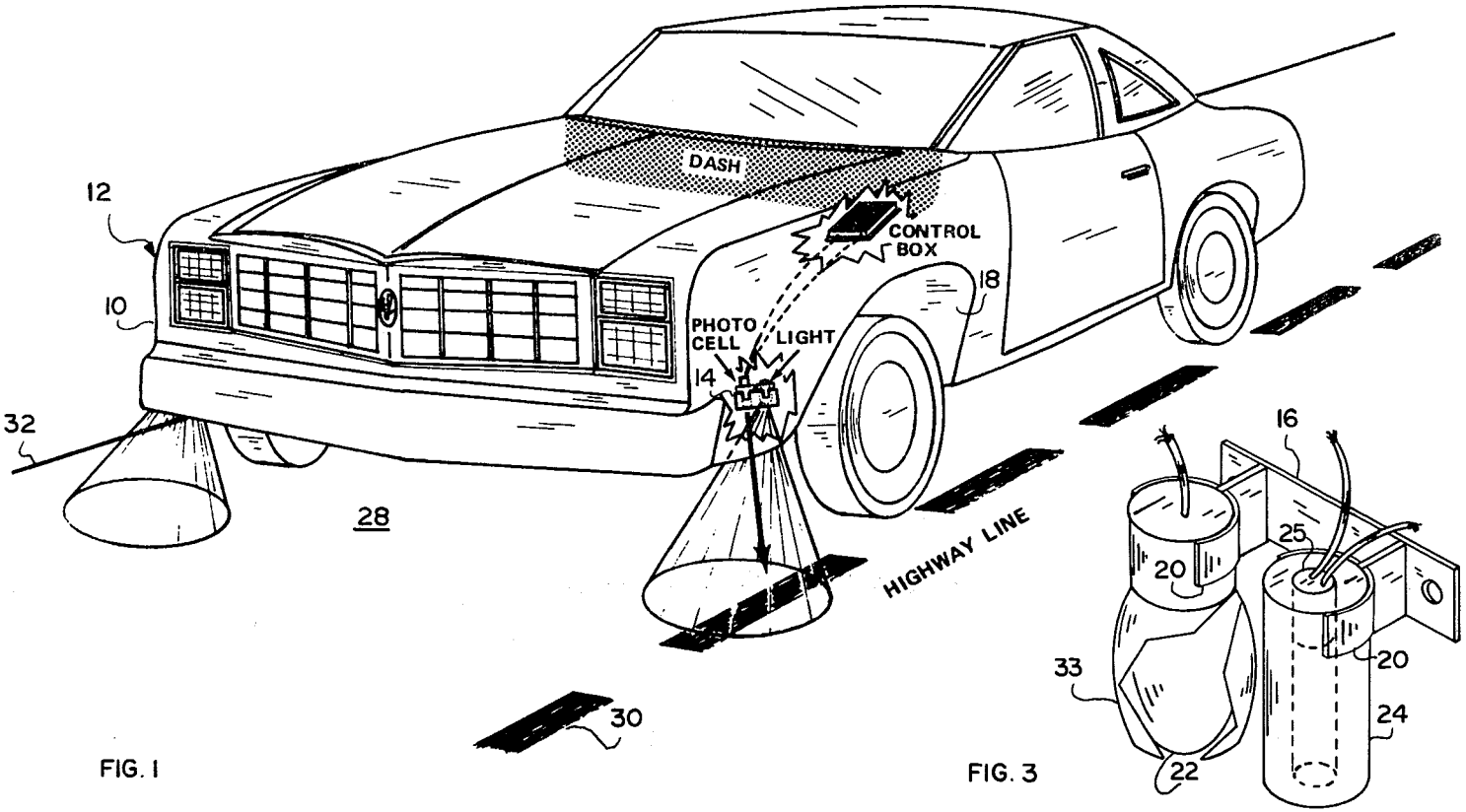
FIG. 1 is a pictorial view of an automobile illustrating the positioning of photosensors and pavement illuminating lights.
FIG. 3 is a pictorial view of a photosensor-light assembly adapted to mount on a front wheel well of an automobile.

Referring to the drawings, and as particularly shown in FIG. 1, a detection assembly 10 would be positioned on the left side of vehicle 12 and a like detection assembly 14 positioned on the right side of the vehicle, each being mounted on a bracket 16 which is attached to the forward portion of front wheel wells 18 by sheet metal screws (not shown). Such a bracket is illustrated in detail in FIG. 3 wherein it is shown that bracket 16 includes a pair of clamps 20, one holding an illuminating bulb 22 and the other a tube 24, in a top end of which is positioned a photodetector 25 of the photoconductive or photoresistive type as a GE type 35MI or a phototransistor type, such as a GE L-14E. Tube 24 is positioned essentially vertically in order for photodetector 25 to receive light essentially vertically from pavement 28 under vehicle 12 to thus respond to vehicle 12 being driven to the left near or across highway line 30 or to the right near or across line 32. A shield 33, such as formed by aluminum foil, is wrapped around illuminating bulb 22 to provide a measure of protection from dirt, the shield extending slighly below the illuminating end of bulb 22.

Referring to FIG. 1, it is to be noted that for purposes of illustration, the highway lines are shown as being dark on a light-colored roadway, the opposite normally being the case, and the operation of the invention would generally be described in terms of the latter.

Figure 2:
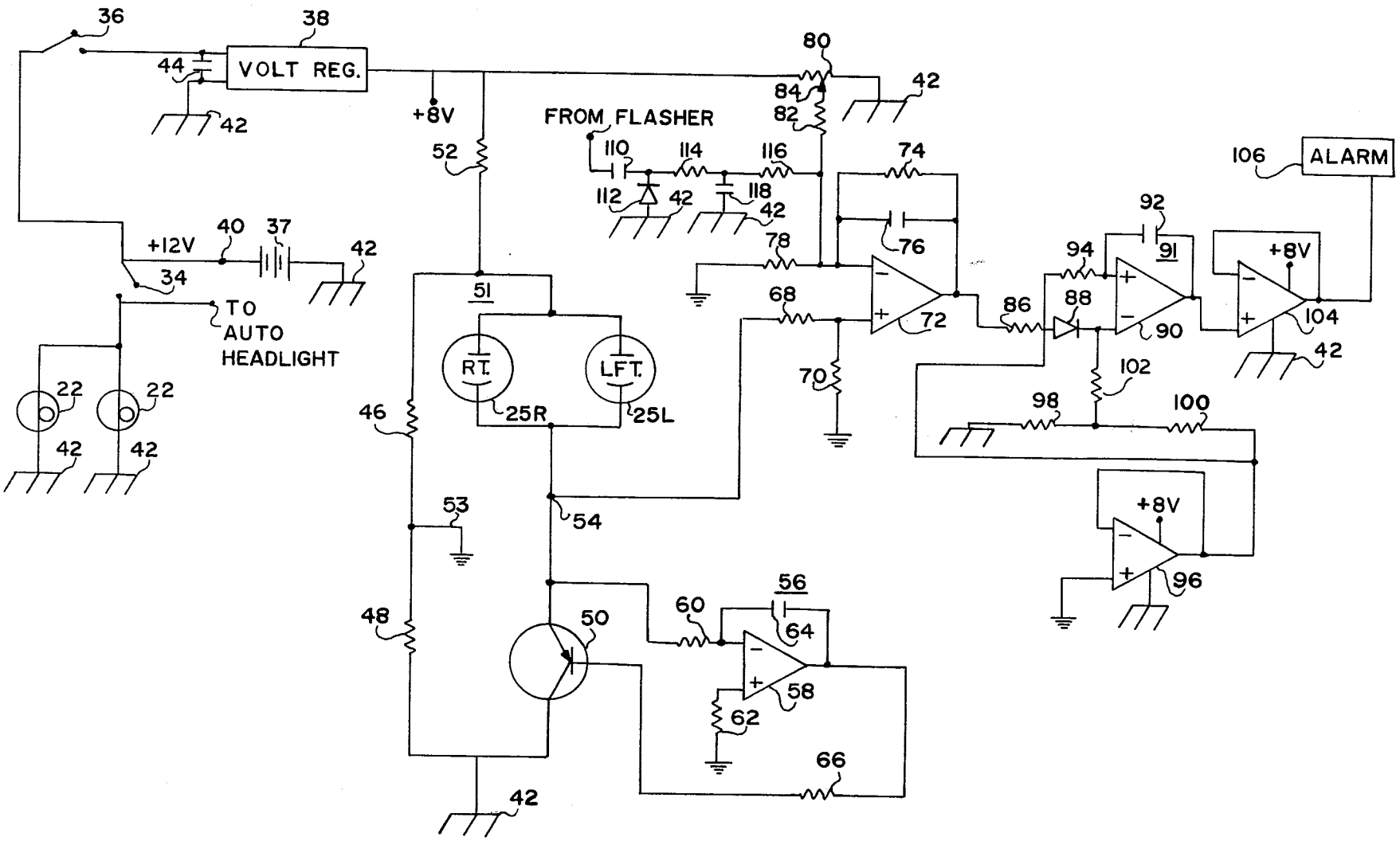
FIG. 2 is an electrical schematic diagram of the system of this invention.

Referring to FIG. 2, it will be noted that illuminating bulbs 22 are only illuminated upon the operation of headlight switch 34 inasmuch as the artificial illumination of the highway is only necessary during darkness. The system in general is turned on by means of switch 36, which applies power to voltage regulator 38 from battery 37 of vehicle 12 connected between terminal 40 and ground terminal 42 to which the battery would typically be connected. Capacitor 44 is connected across the input of voltage regulator 38 to filter out ignition noises on the power line. Voltage regulator 38 provides an 8-volt regulated output to those points in the circuit indicated as being connected to a +8 volt terminal.

Resistors 46 and 48, parallel connected resistive type photosensors 25L and 25R (positioned on the left and right side of vehicle 12, respectively), and transistor 50 are interconnected in a bridge or bridge circuit 51, with an operating bias being applied to it through voltage dropping resistors 52 from voltage regulator 38. The output of the bridge appears between circuit ground terminal 53 and bridge output terminal 54, and in one instance is applied to integrator 56. Integrator 56 includes operational amplifier 58, integrator 56. Integrator 56 includes operational amplifier 58, input resistors 60 and 62, and output to input connected feedback capacitor 64. The time constant of the circuit is determined by the combination of resistor 60 and capacitor 64, and thus values of these elements are chosen to effect a long time constant compared to the impulse signal obtained from a sudden change of light input to either of sensors 25L or 25R. The output of integrator 56 is applied through resistor 66 to the base input of transistor 50, and, as a result, any change in resistance of photosensors 25L and 25R is applied to integrator 56 and averaged by the integrator; and any change occurring over a relatively long period of time (longer than typically required in crossing a line at a relatively low driving speed) produces an output from integrator 56 which causes transistor 50 to change resistance to match the change in resistance across the parallel combination of sensors 25R and 25L, and thus to effect a balance of the bridge responsive to changes in ambient light. Thus, for example, if the initial balance state of the bridge, reflected by zero voltage between terminals 53 and 54, rises by virtue of a decrease in resistance across the photosensors (caused by a "slow" increase in light) and this change persists, this output causes integrator 56 to provide, as connected, a negative output signal which, when applied to the base input of PNP transistor 50, causes the emitter-collector resistance of transistor 50 to decrease until there is again a balance in the bridge, and the output again becomes zero between terminals 53 and 54.

The output of bridge 51 is also applied through resistor 68 and across resistor 70 to the positive input of differential amplifier 72. Resistor 74 and parallel connected capacitor 76 connect between the output of the amplifier and the negative input terminal, and resistor 78 connects the negative input terminal to circuit ground. As connected, resistors 68 and 78 are of equal value, and resistors 70 and 74 are of equal value. The gain of the amplifier is equal to the ratio of resistor 74 to resistor 78, and this gain is that which would be required by the sensitivity of the particular sensor used. Capacitor 76 is of a relatively small value and is chosen to reduce the high frequency response of the amplifier to minimize noise.

Potentiometer 80 is connected between the output of voltage regulator 38 and chassis ground, and it provides an adjustable bias through resistor 82 to the negative input of amplifier 72 to correct for the inherent voltage offset of the amplifier and to set the operating level as the output of amplifier 72. Movable arm 83 of potentiometer 80 provides a bias adjustment for manually setting the threshold at which amplifier 72 would provide an output responsive to a signal from bridge 51.

The output of amplifier 72 is applied through resistor 86 and diode 88 to the negative input of operational amplifier 90 connected as one-shot multivibrator 91 wherein timing capacitor 92 is connected between the output and plus input of amplifier 90. An impedance basically consisting of resistor 94 is connected between the plus input of amplifier 90 and circuit ground through isolation amplifier 96, the latter providing an isolation of circuit ground from transient effects caused by triggering and recovery of the one-shot multivibrator. Resistors 98 and 100 provide through isolation amplifier 96 a voltage divider circuit which through resistor 102 applies a negative bias to the negative input of one-shot multivibrator operation.

The operation of multivibrator 91 requires a positive voltage on the negative terminal of amplifier 90 to trigger, and potentiometer 80 provides a bias to amplifier 72 which biases the output of that amplifier negative, thus acting as a threshold setting for multivibrator 91.

As noted above, a particular feature of this invention is that it provides a variable sensitivity which complements the sensitivity characteristics of typical photosensors, that is, the circuitry is made more sensitive during low light conditions than high light conditions to compensate for typical reduced sensitivity of photosensors at low light levels. This is accomplished as follows.

As the resistance across bridge 51 varies, that is, the resistance between ground point 42 and the lower terminal of resistor 52, the voltage between board ground 53 and vehicle ground 42 varies. Since differential amplifier 72 is referenced to board ground, as shown, the voltage appearing across potentiometer 80 provides a threshold bias to amplifier 72, and the threshold set by a given adjustment of potentiometer 80 actually moved in a negative direction as the bridge or circuit board (terminal 53) to battery or chassis ground 42 voltage increases to require a higher trigger voltage and moves in a positive direction to require a lower trigger voltage when the ground-to-ground voltage decreases. By means of this automatic threshold feature, not only is an optimum threshold sensitivity maintained, but it is particularly helpful in reducing the number of false alarms when the sensor is very sensitive, such as under bright light conditions.

When triggered, multivibrator 91 provides an output to amplifier 104, which in turn applies an amplified output to and energizes alarm 106 to signal that the highway line is being crossed. Capacitor 92 is chosen to provide a delayed recovery from the trigger state so that alarm 106 will be sounded for a desired period, e.g., three to five seconds. Alarm 106 may be of any desired type and may include, where necessary, further amplification means. Typically, the alarm would be in the form of a buzzer or tone generator.

While photoconductive or photoresistive devices are specified for the photosensors, it is to be appreciated that if sufficient sensitivity is obtainable by photovoltaic cells, they may be employed, in which case, typically, the photovoltaic cells, if two are used, would be connected in series and a resistor would be connected in series with them in the top right-hand leg of the bridge.

While it is believed clear that two photosensors should be employed, one on each side of the vehicle, instead of one just on the left side as used by the prior art system discussed above, it is to be appreciated that a single photosensor could be used.

As a further feature of this invention, means are provided to prevent an alarm when a driver deliberately moves from one lane to another, crossing a line such as when he desires to pass another vehicle or to make a turn. In such case, the driver would normally operate a turn signal switch which would provide periodic current pulses to turn signal lights on the vehicle. In accordance with the present invention, the electrical circuit providing these current pulses would be sampled, and the resulting electrical voltage would be applied to a rectifying and filtering circuit consisting of series capacitor 110, parallel rectifier 112, series resistors 114 and 116, and parallel capacitor 118. As a result, a relatively steady positive potential would be developed across capacitor 118 of such a value that, when applied to the negative input of amplifier 72, it would raise the threshold of this amplifier sufficiently to prevent an output of the amplifier when supplied a normal trigger voltage from bridge 51. Accordingly, the alarm of the system would not be triggered during periods when the turn signal was operated.

To examine the general operation of the invention, it will be assumed that by virtue of vehicle 12 moving to the left, photosensor 25L observes the presence of highway line 30, which will be assumed will be of a lighter color than the general color of highway 28. As a result, the resistance of photosensor 25L decreases, and the voltage output between board ground 53 and bridge output terminal 54 moves from zero to some positive value. Previously, potentiometer 80 would have been adjusted so that such a voltage would unbalance amplifier 72 and provide an output to multivibrator 91 sufficient to trigger the multivibrator. As a result, there will occur an output of multivibrator 91 which is fed to amplifier 104, and the output of amplifier 104 then operates alarm 106 to alert the driver to the crossing of a highway line. By virtue of the time constant of multivibrator 91, the multivibrator remains in a triggered state for a finite period even though the triggering signal from bridge 51 drops back to zero, enabling a sufficiently long duration signal to assure that the alarm is observed. At the end of the time period, multivibrator 91 returns to its normal quiescent state and the alarm is turned off.

From the foregoing it will be appreciated that the invention provides a clearly improved roadway line detection and alarm system. The bridge circuit of the system is maintained in balance without the necessity of an auxiliary ambient state photosensor and without the need of lighting devices in the daytime. The threshold of the system is varied to maintain a relatively constant detection process over widely varying light conditions. Further, by means of the use of balanced circuitry, particularly by the differential amplifiers employed in amplifier 72 and one-shot multivibrator 91, and the fact that these amplifiers would typically be integrated circuits with temperature compensation, a high degree of stability, both thermal and electrical, is achieved. For example, in the very noisy electronic environment in which the device must operate in view of ignition noises, the balanced type circuitry effectively cancels out the impulse type noise present at the inputs of the amplifiers and thus prevents false alarms. To avoid alarms when a driver is deliberately crossing a highway line, which is normally signalled by the driver by operation of a turn signal, the circuitry is disabled by the presence of the turn signal, and thus the alarm is avoided.

Having thus described our invention, what is claimed is:

1. A highway line detector comprising:

photoresponsive means, having a pair of electrical terminals and adapted to be mounted on a side region of the underside of a motor vehicle, for varying electrical impedance between said terminals as a function of the magnitude of light reflected off of the pavement of a highway;

a source of electrical bias;

an electrical bridge comprising:

first and second input terminals and first and second output terminals, first, second, third, and fourth impedance elements, each impedance element being connected between a separate combination of an input terminal and output terminal, and said source of bias being connected across said input terminals, said photoresponsive means comprising said first impedance element, and signal responsive impedance means, comprising one of the three other impedance elements, and responsive to an applied signal, for varying its impedance;

integrating means responsive to signal across said output terminals for applying signals to said signal responsive impedance means, and therefrom varying the impedance of said signal responsive means in a direction, whereby said bridge is balanced for conditions of ambient light; and alarm means responsive to a discrete signal change across said output terminals of said bridge for providing an alarm.

2. A highway line detector as set forth in claim 1 wherein said photoresponsive means comprises two photosensors, each being mounted on a discrete side region on the underside of a motor vehicle, whereby the crossing of a highway line on either side of a motor vehicle would be detected.

3. A highway line detector as set forth in claim 1 further comprising threshold means responsive to the level of current through said electrical bridge for varying the threshold response of said alarm means to a signal change as a function of ambient light, whereby the signal threshold of operation of said alarm means is adjustable as a function of the sensitivity, change in light to change in signal output, of said bridge.

4. A highway line detector as set forth in claim 3 wherein:

said source of electrical bias comprises:

a battery suplying power for said motor vehicle, and a voltage regulator, an electrical resistor, and said input terminals of said electrical bridge being connected in series across said battery; and said threshold means comprises:

a potentiometer connected across the circuit comprising said resistor and input terminals of said electrical bridge, and a differential amplifier, one input of which is connected to an output terminal of said electrical bridge, and the other input is connected to said potentiometer, whereby adjustment of said potentiometer provides a manual form of adjustment of the signal threshold at which said differential amplifier will provide a discrete output, and the voltage input is applied through said potentiometer to said input of said differential amplifier as the other with respect to an output terminal of said electrical bridge, whereby the signal balance input of said differential amplifier is automatically adjusted as a function of current flow through said electrical bridge.

5. A highway line detector as set forth in claim 2 wherein said alarm means comprises means for providing an alarm for a discrete period following a said discrete signal change.

6. A highway line detector as set forth in claim 5 wherein said alarm means includes a one-shot multivibrator having an input connected to receive a signal responsive to said discrete signal change;

said multivibrator is connected to provide a discrete period of output following the receipt of a said discrete signal change; and a signal responsive alarm is connected to the output of said one-shot multivibrator.

7. A highway line detector as set forth in claim 6 wherein said multivibrator comprises a differential amplifier wherein:

one input is connected to receive said discrete signal change;

a timing capacitor is connected between the output of said last-named differential amplifier and the other input of said differential amplifier; and said highway line detector further comprises signal isolation means for providing bias inputs to said last-named differential amplifier referenced to one of said bridge output terminals, a reference terminal, which last-named means comprises means for isolating transient signal energy appearing on said input of said last-named differential amplifier and preventing transient signal energy from being fed back to said bridge.

8. A highway line detector as set forth in claim 5 further comprising signal means connected to a turn signal flasher of said motor vehicle and in circuit with said alarm means for disabling said alarm means, whereby a vehicle being intentionally driven across a highway parking line will not cause said alarm means to be operated.

9. A highway line detector as set forth in claim 8 wherein said signal means comprises electrical storage means responsive to periodic signals from a turn signal flasher for storing an electrical charge and then applying a continuous disabling signal in circuit with said alarm means during periods when said signal flasher is in operation, whereby during this period said alarm means is disabled.

* * * * *